US007402958B2

(12) United States Patent
Nguyen

(10) Patent No.: US 7,402,958 B2
(45) Date of Patent: Jul. 22, 2008

(54) DISPLAY POWER PARTITIONING

(75) Inventor: Don J. Nguyen, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 101 days.

(21) Appl. No.: 10/609,822

(22) Filed: Jun. 30, 2003

(65) Prior Publication Data

US 2004/0263133 A1 Dec. 30, 2004

(51) Int. Cl.
*H05B 37/02* (2006.01)

(52) U.S. Cl. ..... 315/291; 315/307; 323/224; 323/272

(58) Field of Classification Search ..... 315/224, 315/291, 307, 209 R, 219, 225; 323/222, 323/272, 304, 224, 282–284
See application file for complete search history.

(56) References Cited

U.S. PATENT DOCUMENTS 5,532,524 A * 7/1996 Townsley et al. ..... 307/64
5,548,189 A * 8/1996 Williams ..... 315/224
6,181,084 B1 * 1/2001 Lau ..... 315/291
6,275,016 B1 * 8/2001 Ivanov ..... 323/224
6,465,993 B1 * 10/2002 Clarkin et al. ..... 323/272
6,593,725 B1 * 7/2003 Gallagher et al. ..... 323/284
6,865,682 B1 * 3/2005 Talbot et al. ..... 713/300
7,187,140 B2 * 3/2007 Ball ..... 315/291

* cited by examiner

*Primary Examiner*—Douglas W. Owens
*Assistant Examiner*—Jimmy T Vu
(74) *Attorney, Agent, or Firm*—Kacvinsky LLC

(57) ABSTRACT

According to one embodiment of the present invention, a voltage regulator is disclosed. The voltage regulator includes a step-down portion to step down an input voltage to a desired voltage when the input voltage is provided by a battery power source; and a step-up portion to step up the input voltage to the desired voltage when the input voltage is provided by a system rail. In accordance with another embodiment of the present invention, the voltage regulator provides power to a display device such as an LCD, a flat panel display, a plasma screen, and a TFT display.

16 Claims, 5 Drawing Sheets

DISPLAY POWER PARTITIONING

COPYRIGHT NOTICE

Contained herein is material that is subject to copyright protection. The copyright owner has no objection to the facsimile reproduction of the patent disclosure by any person as it appears in the Patent and Trademark Office patent files or records, but otherwise reserves all rights to the copyright whatsoever.

FIELD OF THE INVENTION

The present invention generally relates to the field of electronic displays. More particularly, an embodiment of the present invention relates to partitioning power in liquid crystal display (LCD) panels.

BACKGROUND

Notebook (also called laptop) computers are lightweight personal computers, which are quickly gaining popularity. The popularity of the notebook computers has especially increased since their prices have been dropping steadily, while maintaining similar performance as their larger siblings (i.e., desktop computers or workstations). One clear advantage of notebook computers is their ease of portability. The lighter weight restrictions require the mobile platform manufacturers to produce images that compete with the desktop models, while marinating an increased battery life.

As more functionality is integrated within mobile computing platforms, the need to reduce power consumption becomes increasingly important. Furthermore, users expect increasingly longer battery life in mobile computing platforms, furthering the need for creative power conservation solutions. Mobile computer designers have responded by implementing power management solutions such as, reducing processor and chipset clock speeds, intermittently disabling unused components, and reducing power required by display devices, such as an LCD or "flat panel" display.

Generally, today's notebook computer display panels consume about ten percent of the total platform power. As a result, the display system power efficiency becomes more important when trying to lower power consumption. The power driving an LCD is usually taken from a laptop power rail (e.g., 3 Volts) which itself is provided by stepping down the battery power (e.g., 8-21 Volts).

The LCD displays, however, may require a stepped up voltage (e.g., around 7 Volts). The stepping down and up of the voltage from the voltage source results in inefficiencies, which may be exasperated when cascaded. For example, the cascaded inefficiency may reach thirty percent in some systems, resulting in significant power loss and shortening of battery life in portable systems.

BRIEF DESCRIPTION OF THE DRAWINGS

The invention is illustrated by way of example and not limitation in the figures of the accompanying drawings, in which like references indicate similar or identical elements, and in which.

DETAILED DESCRIPTION

In the following detailed description of the present invention numerous specific details are set forth in order to provide a thorough understanding of the present invention. However, it will be apparent to one skilled in the art that the present invention may be practiced without these specific details. In other instances, well-known structures and devices are shown in block diagram form, rather than in detail, in order to avoid obscuring the present invention.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

Figure 1:
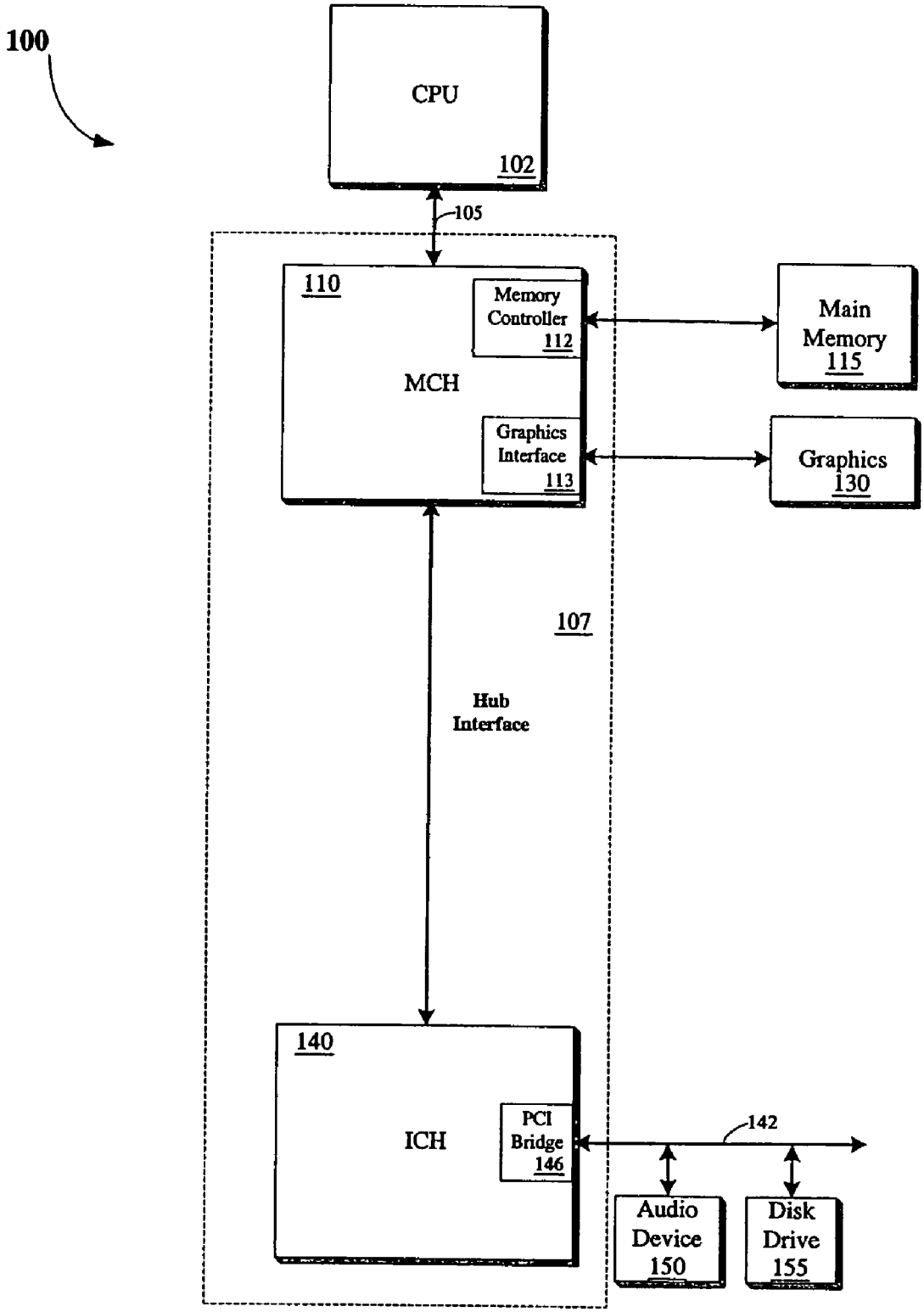
FIG. 1 illustrates an exemplary block diagram of a computer system 100 in accordance with an embodiment of the present invention.

FIG. 1 illustrates an exemplary block diagram of a computer system 100 in accordance with an embodiment of the present invention. The computer system 100 includes a central processing unit (CPU) 102 coupled to a bus 105. In one embodiment, the CPU 102 is a processor in the Pentium® family of processors including the Pentium® II processor family, Pentium® III processors, Pentium® IV processors available from Intel Corporation of Santa Clara, Calif. Alternatively, other CPUs may be used, such as Intel's XScale processor, Intel's Banias Processors, ARM processors available from ARM Ltd. of Cambridge, the United Kingdom, or OMAP processor (an enhanced ARM-based processor) available from Texas Instruments, Inc., of Dallas, Tex.

A chipset 107 is also coupled to the bus 105. The chipset 107 includes a memory control hub (MCH) 110. The MCH 110 may include a memory controller 112 that is coupled to a main system memory 115. Main system memory 115 stores data and sequences of instructions that are executed by the CPU 102 or any other device included in the system 100. In one embodiment, main system memory 115 includes dynamic random access memory (DRAM); however, main system memory 115 may be implemented using other memory types. Additional devices may also be coupled to the bus 105, such as multiple CPUs and/or multiple system memories.

The MCH 110 may also include a graphics interface 113 coupled to a graphics accelerator 130. In one embodiment, graphics interface 113 is coupled to graphics accelerator 130 via an accelerated graphics port (AGP) that operates according to an AGP Specification Revision 2.0 interface developed by Intel Corporation of Santa Clara, Calif. In an embodiment of the present invention, a flat panel display may be coupled to the graphics interface 113 through, for example, a signal converter that translates a digital representation of an image stored in a storage device such as video memory or system memory into display signals that are interpreted and displayed by the flat-panel screen. It is envisioned that the display signals produced by the display device may pass through various control devices before being interpreted by and subsequently displayed on the flat-panel display monitor.

In addition, the hub interface couples the MCH 110 to an input/output control hub (ICH) 140 via a hub interface. The ICH 140 provides an interface to input/output (I/O) devices within the computer system 100. The ICH 140 may be coupled to a Peripheral Component Interconnect (PCI) bus adhering to a Specification Revision 2.1 bus developed by the PCI Special Interest Group of Portland, Oreg. Thus, the ICH 140 includes a PCI bridge 146 that provides an interface to a PCI bus 142. The PCI bridge 146 provides a data path between the CPU 102 and peripheral devices.

The PCI bus 142 includes an audio device 150 and a disk drive 155. However, one of ordinary skill in the art will appreciate that other devices may be coupled to the PCI bus 142. In addition, one of ordinary skill in the art will recognize that the CPU 102 and MCH 110 could be combined to form a single chip. Furthermore, graphics accelerator 130 may be included within MCH 110 in other embodiments.

In addition, other peripherals may also be coupled to the ICH 140 in various embodiments. For example, such peripherals may include integrated drive electronics (IDE) or small computer system interface (SCSI) hard drive(s), universal serial bus (USB) port(s), a keyboard, a mouse, parallel port (s), serial port(s), floppy disk drive(s), digital output support (e.g., digital video interface (DVI)), and the like. Moreover, the computer system 100 is envisioned to receive electrical power from one or more of the following sources for its operation: a battery, alternating current (AC) outlet (e.g., through a transformer and/or adaptor), automotive power supplies, airplane power supplies, and the like.

Figure 2:
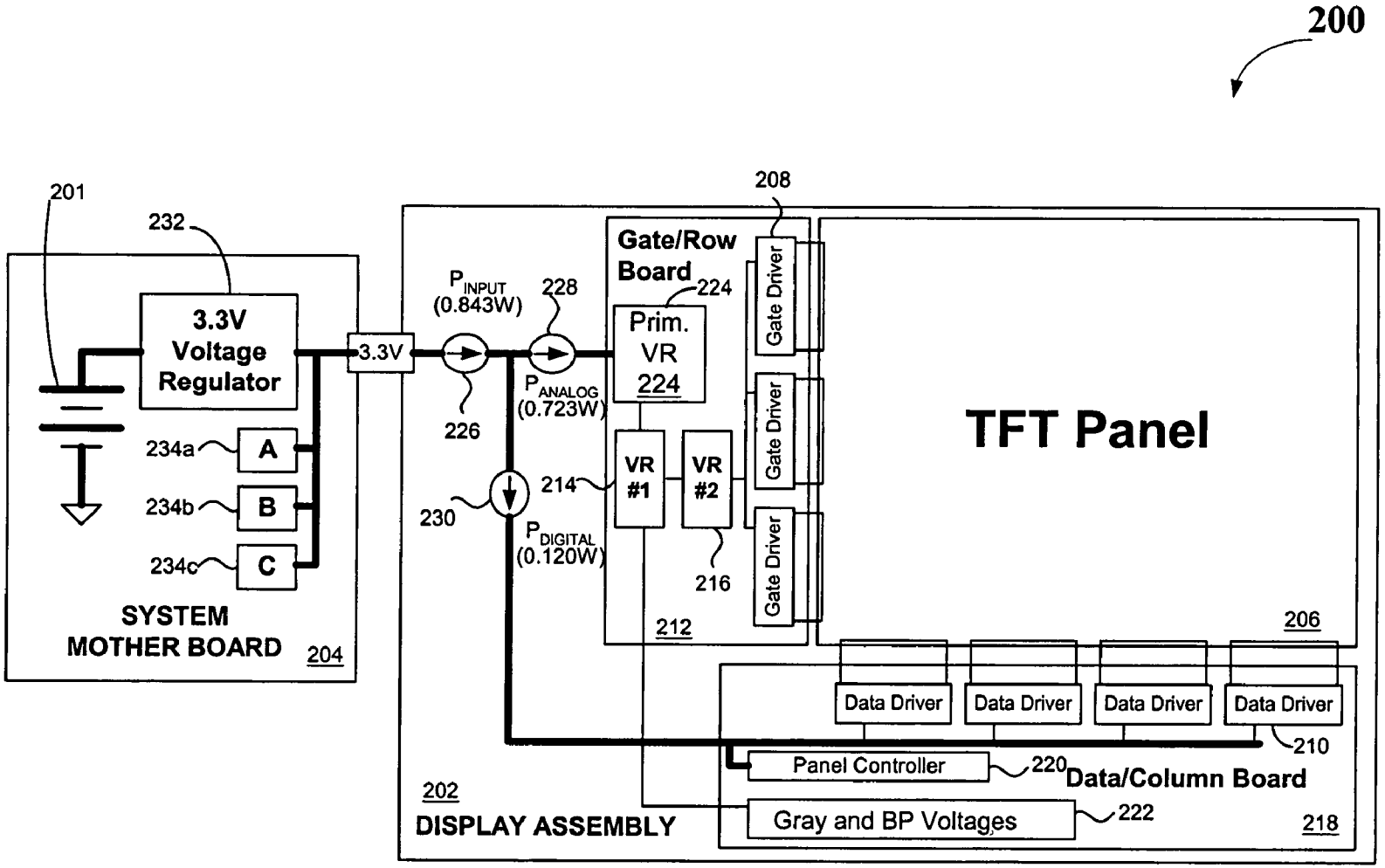
FIG. 2 illustrates an exemplary block diagram of a thin film transistor (TFT) display panel system 200 in accordance with an embodiment of the present invention.

FIG. 2 illustrates an exemplary block diagram of a thin film transistor (TFT) display panel system 200 in accordance with an embodiment of the present invention. In one embodiment of the present invention, the display system 200 may be coupled to the graphics interface 113 of FIG. 1 through, for example, a signal converter that translates a digital representation of an image stored in a storage device such as video memory or system memory into display signals that are interpreted and displayed by the display system 200. In various embodiment of the present invention, other types of displays may be utilized such as an LCD, a flat panel display, or a plasma screen.

The display system 200 includes a power source 201 (e.g., a battery), a display assembly 202, and a system motherboard 204. In accordance with an embodiment of the present invention, the power source 201 may utilize NiCad, NiMH, Li-Ion, or other types of batteries. The display assembly 202 includes a TFT panel 206 to, for example, display images. The TFT panel 206 receives input from gate drivers 208 and data drivers 210 regarding images to be displayed on the TFT panel 206. The display assembly 202 further includes a gate/row board 212, which may house the gate drivers 208 and voltage regulators 214 and 216. The display assembly 202 also includes a data/column board 218 which may house the data drivers 210, a panel controller 220, and a gray and back plane (BP) voltages device 222 to produce gray levels (e.g., 256 levels) and back plane root-mean-square (RMS) voltages (e.g., to avoid burning the screen with direct current (DC) voltages).

As illustrated in FIG. 2, the gray and BP voltages device 222 may be coupled to the voltage regulator 214 to regulate the output of the device 222. The gate/row board 212 further includes a primary voltage regulator 224, which is coupled to and provides input to the voltage regulator 214. The primary voltage regulator 224 and various elements of the data/column board 218 may be driven through a number of current sources such as $P_{INPUT}$ 226 $P_{ANALOG}$ 228 and $P_{DIGITAL}$ 230.

In one embodiment of the present invention, the $P_{INPUT}$ 226 may use 0.843 W (e.g., which may be a combination of 0.723 W for $P_{ANALOG}$ 228 and 0.120 W for $P_{DIGITAL}$ 230). The $P_{INPUT}$ 226 may receive its input from a 3.3 V voltage regulator 232. In an embodiment of the present invention, the voltage regulator 232 may reside on the system motherboard 204. In a further embodiment of the present invention, the voltage regulator 232 may also provide regulated voltage to other components of the system motherboard (such as 234*a-c*).

Accordingly, in accordance with one embodiment of the present invention, a display panel may utilize the 3.3 V power rail from the system and convert it to a higher voltage to be used to provide the gate driver inputs for the TFT display panel. In accordance with an embodiment of the present invention, the voltage regulator 224 is a 7.0 V boost voltage regulator with a 493 mW output.

Figure 3:
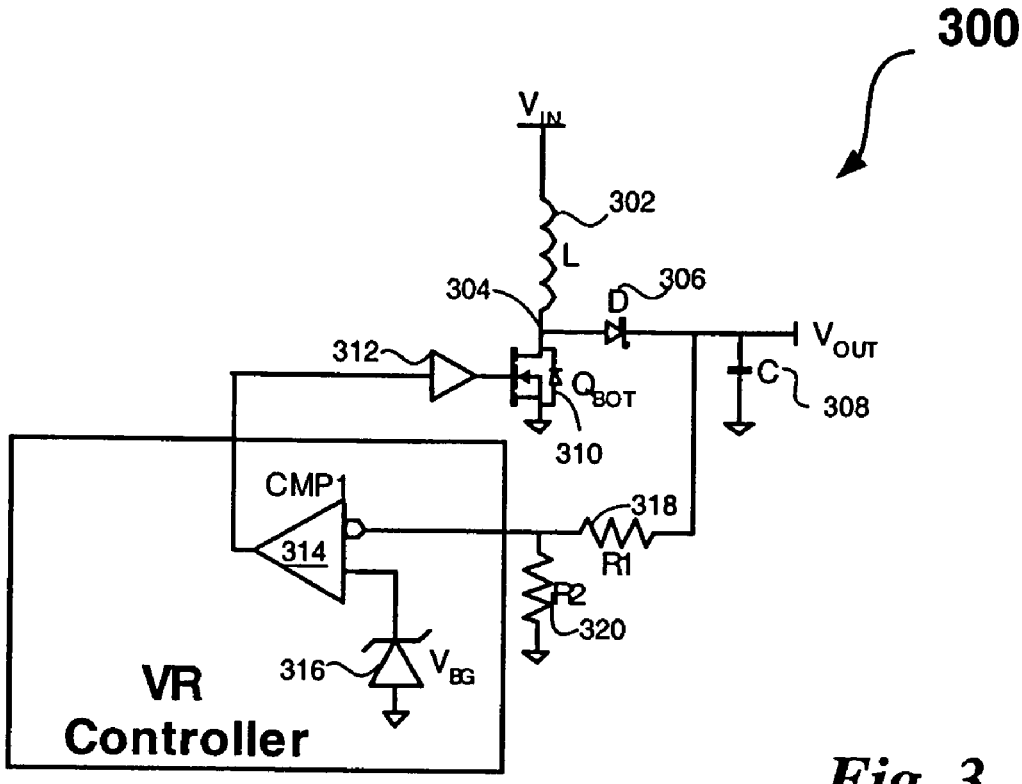
FIG. 3 illustrates an exemplary circuit diagram of a step up voltage regulator 300 in accordance with one embodiment of the present invention.

FIG. 3 illustrates an exemplary circuit diagram of a step up voltage regulator 300 in accordance with one embodiment of the present invention. In one embodiment of the present invention, the step regulator 300 may be utilized for the primary voltage regulator 224 of FIG. 2. In such an embodiment, the display panel uses the 3.3 V power rail from the system and converts it up to a higher voltage (e.g., 7.0 to 7.7 V) to provide power to the gate drivers (such as gate drivers 208 and/or the data drivers 210 of FIG. 2) to drive the gate lines of them TFT display panel shown in FIG. 2.

The voltage regulator 300 includes an inductor 302 which is coupled between a voltage input ($V_{IN}$) and a node 304. The node 304 provides an input to a diode 306, which provides an output to an output node ($V_{OUT}$) 308. The voltage regulator 300 further includes a transistor 310 ($Q_{BOT}$), which is coupled between the node 304 and ground. In accordance with various embodiment of the present invention, the transistors discussed herein may be field-effect transistors (FETs) such as metal-oxide semiconductor FETs (MOSFETs).

The gate of the transistor 310 receives its input through a driver 312, which receives its input from a comparator 314. The comparator 314 is further coupled to the ground through a diode 316 ($V_{BG}$), which is in turn coupled to the ground and the output of the diode 306 through a resistor 318. As illustrated in FIG. 3, one end of the transistor 318 may be coupled to the ground through a resistor 320 prior to providing input to the comparator 314. The voltage regulator 300 further includes a capacitor 308 which may be coupled between the optic node ($V_{OUT}$) and ground.

In accordance with an embodiment of the present invention, step-up voltage regulators may have relatively higher power loss associated with them, for example, due to limitations such as max duty cycle or magnetic charge storage/loss. As such, its power conversion efficiency may be about 70%-80%. Considering the power loss associated with the 3.3V voltage regulator (stepping down from battery voltage, 11.1 to 3.3V), roughly 10%, the step-up voltage regulator's efficiency is further lower due to cascading efficiency loss. As a result, the overall battery-to-7.7V efficiency for this battery-to-3.3V-to-7.7V power partitioning may be about 70%. The inefficiency, or power loss incurred during this battery-to-3.3V-to-7.7V conversion may be about 30%. Since display panel power is about 1 W, this represents about 300 mW of power loss.

Figure 4:
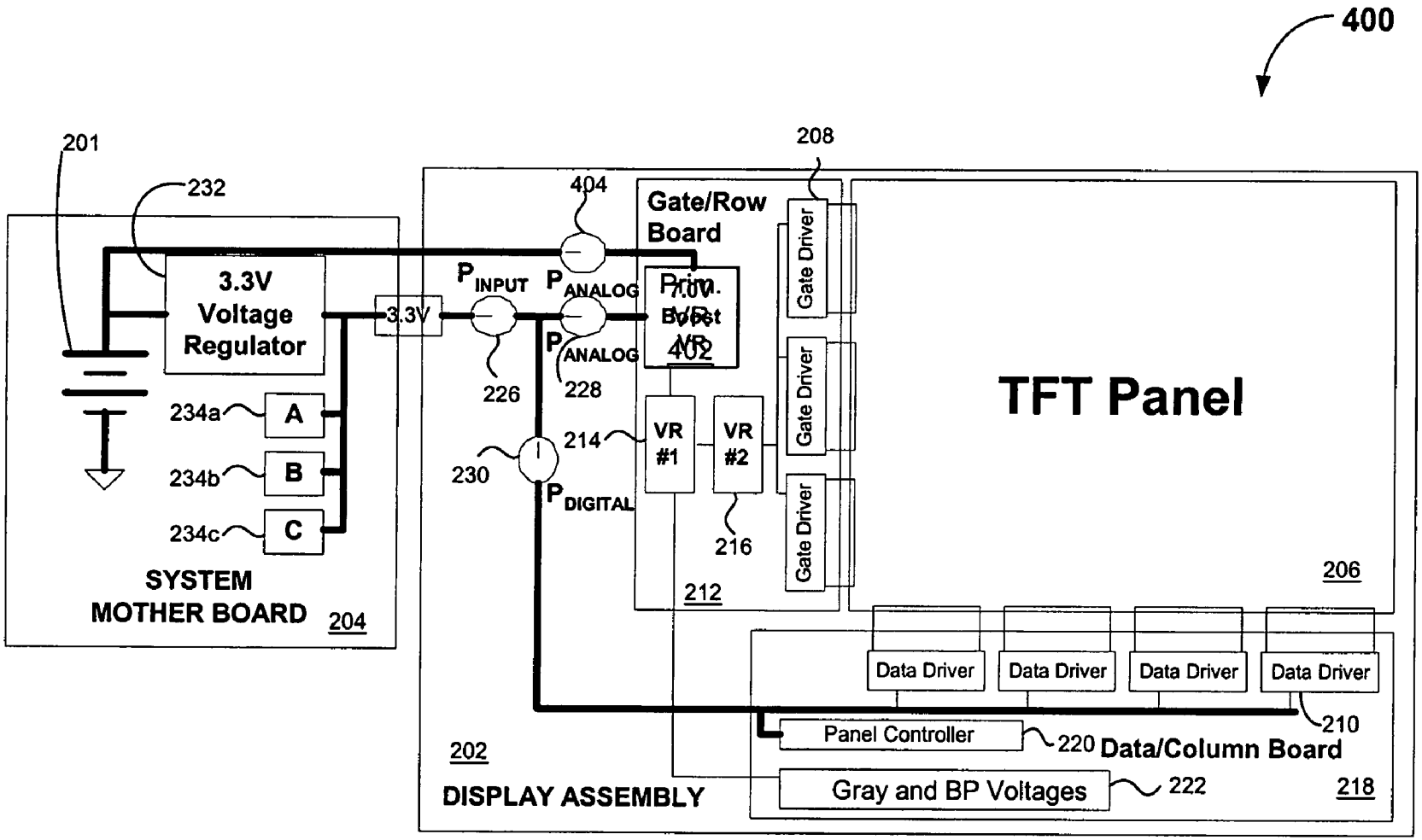
FIG. 4 illustrates an exemplary block diagram of a TFT display panel system 400 in accordance with an embodiment of the present invention.

FIG. 4 illustrates an exemplary block diagram of a TFT display panel system 400 in accordance with an embodiment of the present invention. In one embodiment of the present invention, the display system 400 may be similar to or the same as the display system 200 of FIG. 2 with the exception of replacing the primary voltage regulator 224 with a step down voltage regulator 402 and feeding power to the voltage regulator 402 directly from a battery source through a current source 404.

The display system 400 includes the power source 201, the display assembly 202, the system motherboard 204, the TFT panel 206, gate drivers 208, data drivers 210, voltage regulators 214 and 216, the data/column board 218, the panel controller 220, and the gray and BP voltages device 222, the current sources 226-230.

Figure 5:
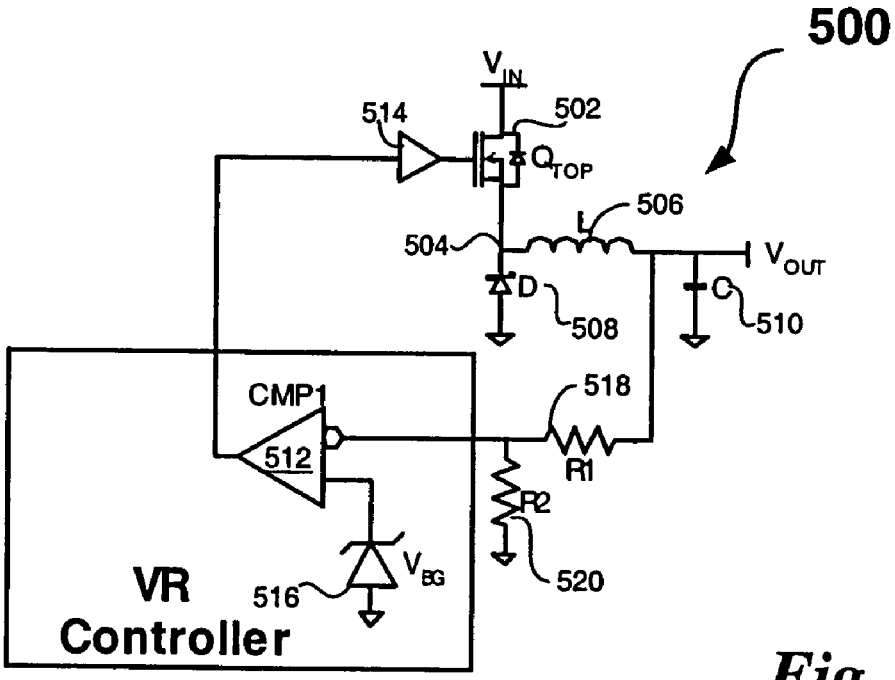
FIG. 5 illustrates an exemplary circuit diagram of a step down voltage regulator 500 in accordance with one embodiment of the present invention.

FIG. 5 illustrates an exemplary circuit diagram of a step down voltage regulator 500 in accordance with one embodiment of the present invention. In one embodiment of the present invention, the voltage regulator 500 may be utilized in place of the primary voltage regulator 402 of FIG. 4. The voltage regulator 500 includes a transistor 502 ($Q_{TOP}$), which is coupled between an input node ($V_{IN}$) and a node 504. The node 504 is coupled to an output node ($V_{OUT}$) through an inductor 506. The node 504 is also coupled to the ground through a diode 508. The output node ($V_{OUT}$) may be coupled to the ground through a capacitor 510. In one embodiment of the present invention, the voltage regulator 500 receives its input power directly from the power source 201 (such as a battery).

In another embodiment of the present invention, the voltage regulator 500 steps down its input voltage to about 7.7 V to be used by a display such as those discussed herein. The voltage regulator 500 may further include a comparator 512, which provides its output to a driver 514, in turn driving the gate of the transistor 502. The comparator 512 receives its input from the ground (through a diode 516) and the output node ($V_{OUT}$) through a resistor 518. The resistor 518 may also be coupled to the ground through a register 520.

In a further embodiment of the present invention, similar components (transistor, inductor, diode, etc.) are used as those in the step-up voltage regulator of FIG. 3. From an operational standpoint, however, there may be several differences between the two designs. For example, the magnetic inductor in the step-down voltage regulator 500 does not have to store energy. As such, its power consumption is lower. Similarly, the switching current through the transistor of the step-down voltage regulator 500 is much lower than that of the transistor used in the step-up voltage regulator 300. As such, its power consumption is lower as well.

Overall efficiency of the step-down voltage regulator 500 may be about 95%. Power loss associated with this topology may be then only about 5%. Moreover, there may be no cascade loss in this design. The overall loss may be, therefore, incurred in the battery-to-7.7V step-down voltage regulator, which may be about 5% or about 50mW for a 1 W display panel power. Accordingly, there may be a 250mW power reduction in such an embodiment of the present invention.

Figure 6:
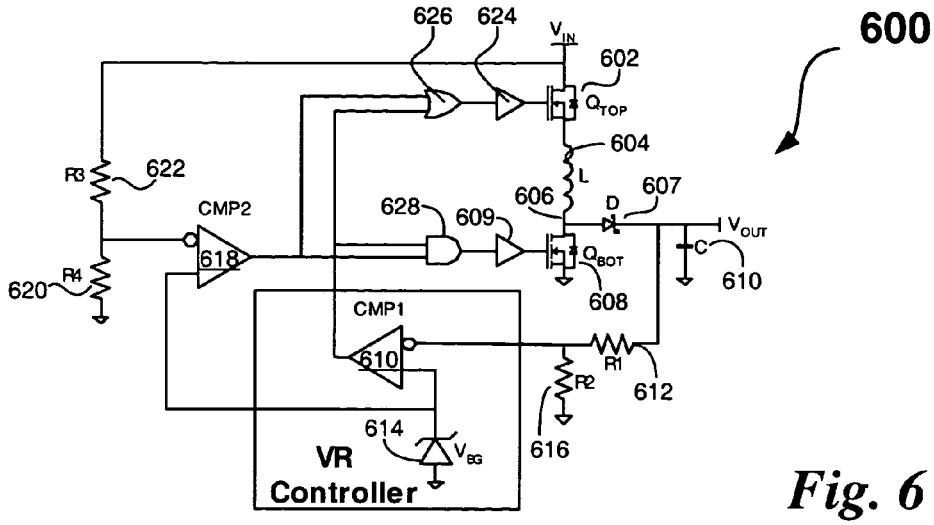
FIG. 6 illustrates a combined step up/step down voltage regulator 600 in accordance with an embodiment of the present invention.

FIG. 6 illustrates a combined step up/step down voltage regulator 600 in accordance with an embodiment of the present invention. The voltage regulator 600 includes a transistor 602 ($Q_{TOP}$), which is coupled between an input node and an inductor 604. The inductor 604 is coupled to a node 606, which is in turn coupled to an output node ($V_{OUT}$) through a diode 607. The output node ($V_{OUT}$) may be coupled to the ground through a capacitor 610.

As illustrated in FIG. 6, the voltage regulator 600 also includes a transistor 608 ($Q_{BOT}$), which is coupled to the node 606 and ground. The transistor 608 receives its input from a driver 609. The voltage regulator 600 further includes a comparator 610 that receives its input from the output node ($V_{OUT}$) through a resistor 612 and ground through a diode 614. The resistor 612 may also be coupled to the ground as shown in FIG. 6 through a resistor 616. The voltage regulator 600 includes a second comparator 618, which receives its input from inputs from the diode 614 and ground through a resistor 620. The ground signal may also be provided to the input node ($V_{IN}$) through the resistor 620 and another resistor 622.

In accordance with an embodiment of the present invention, the voltage regulator 600 requires a change to the input power source of the display panel. A change of 3.3V to battery power source is required. As such, it may be difficult to provide forward compatibility. In a further embodiment of the present invention, a voltage regulator that can run both as a step-up or step-down topology depending on the voltage level of the input power is disclosed. For example, if the input power is a 3.3V, then the voltage regulator operates in a step-up topology. If the input power is a battery source (e.g., 8.4-21V), then the said voltage regulator operates in a step-down topology.

The transistor 602 receives its input at the gate from a driver 624 which in turn receives its input from an OR gate 626. Similarly, the driver 609 receives it input from an AND gate 628. Both the OR gate 626 and the AND gate 628 receive their inputs from the comparator 610 and comparator 618 as shown in FIG. 6.

Referring to the FIG. 6 for such a voltage regulator. Resistors R3/R4 (620 and 622) and comparator 618 are used as a voltage monitors. If the input voltage ($V_{IN}$) is greater than 3.3 V, then comparator 610 outputs a logic low signal. The gate of the transistor 608 ($Q_{BOT}$) is held low keeping it off. The internal body diode of $Q_{BOT}$ may still function as the diode used in the step down voltage regulator of FIG. 5. The OR gate 626 enables the output of the comparator 610 to drive the gate of the transistor 602 as in the step down voltage regulator of FIG. 5.

Similarly, if $V_{IN}$ is 3.3 V, then the output of the comparator 618 is a logic high. The OR gate 626 keeps the transistor 602 on regardless of the output of the comparator 610. The AND gate 628, however, enables the output of the comparator 610 to reach the gate of the transistor 608, allowing $Q_{BOT}$ to operate similar to that of the step up voltage regulator of FIG. 3.

Figure 7:
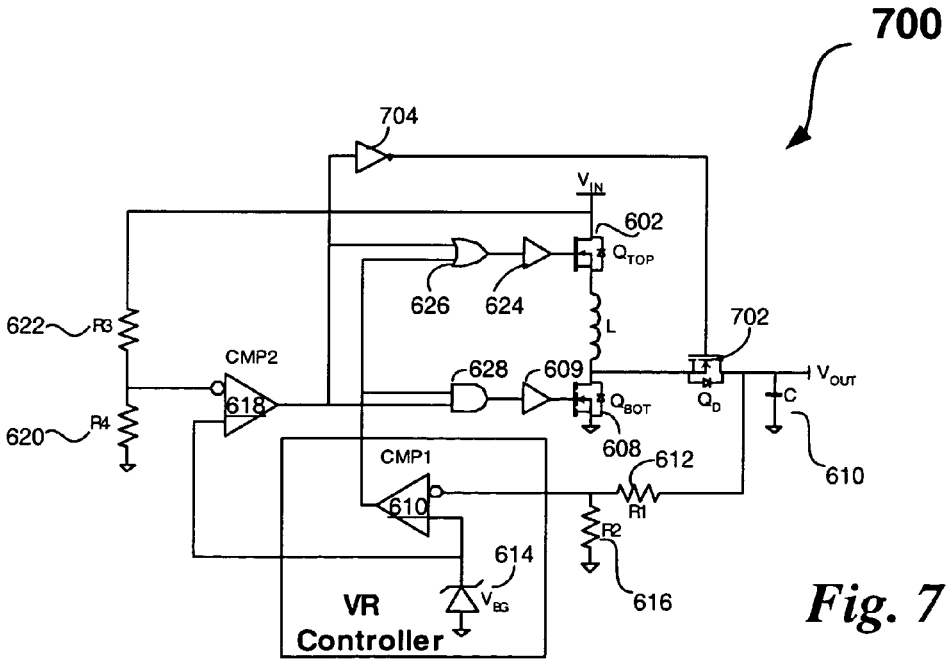
FIG. 7 illustrates an exemplary combined step up/step down voltage regulator 700 in accordance with an embodiment of the present invention.

FIG. 7 illustrates an exemplary combined step up/step down voltage regulator 700 in accordance with an embodiment of the present invention. In one embodiment of the present invention, the voltage regulator 700 may be constructed by replacing the diode 607 of FIG. 6 with a transistor 702 ($Q_D$) and an inverter 704, as illustrated in FIG. 7. In accordance with an embodiment of the present invention, it is envisioned that power dissipation of the diode 607 may be reduced during the step down mode by replacing it with a transistor 702 and inverter 704 as shown in FIG. 7.

Whereas many alterations and modifications of the present invention will no doubt become apparent to a person of ordinary skill in the art after having read the foregoing description, it is to be understood that any particular embodiment shown and described by way of illustration is in no way intended to be considered limiting. For example, the techniques described herein may be equally beneficial in non-mobile platforms (such as desktop or workstation computer systems) to reduce power consumption. Therefore, references to details of various embodiments are not intended to limit the scope of the claims which in themselves recite only those features regarded as essential to the invention.

What is claimed is:

1. A voltage regulator comprising:

a step-down portion to step down an input voltage to a desired voltage when the input voltage is provided by a battery power source, wherein the utilization of the step-down portion reduces power loss;

a step-up portion to step up the input voltage to the desired voltage when the input voltage is provided by a system rail of a motherboard, wherein power loss reduction is provided through one or more techniques selected from a group comprising of lessening energy storage in a component of the voltage regulator and lessening cascade power loss;

a first comparator to compare an output voltage of the voltage regulator with a first reference voltage; and a second comparator to compare the input voltage of the voltage regulator with a second reference voltage.

2. The voltage regulator of claim 1 wherein the voltage regulator provides power to a display device.

3. The voltage regulator of claim 2 wherein the display device is selected from a group comprising a liquid crystal display (LCD), a flat panel display, a plasma screen, and a thin film transistor (TFT) display.

4. The voltage regulator of claim 1 wherein the desired voltage is about 7.7 V.

5. The voltage regulator of claim 1 wherein the component is a magnetic inductor.

6. The voltage regulator of claim 1 further including a voltage regulator controller to control an output voltage of the voltage regulator.

7. The voltage regulator of claim 1 wherein Lau voltage and the second reference voltage are derived from ground.

8. The voltage regulator of claim 1 further including a transistor to pull up the voltage regulator output voltage in accordance with a result of an OR function applied to outputs of the first and second comparators.

9. The voltage regulator of claim 1 further including a transistor to pull down the voltage regulator output voltage in accordance with a result of an AND function applied to outputs of the first and second comparators.

10. The voltage regulator of claim 1 wherein the system rail is at about 3.3 V.

11. A voltage regulator comprising:

a step down-portion of a display panel system to step down an input voltage to a desired voltage when the input voltage is provided by a battery power source;

a voltage regulator controller coupled to the step down portion to control an output of the voltage regulator, wherein power loss reduction is provided through one or more techniques selected from a group comprising of lessening energy storage in a component of the voltage regulator and lessening cascade power loss;

a step-up portion to step up the input voltage to the desired voltage when the input voltage is provided by a system rail;

a first comparator to compare an output voltage of the voltage regulator with a first reference voltage; and a second comparator to compare the input voltage of the voltage regulator with a second reference voltage.

12. The voltage regulator of claim 11 wherein the voltage regulator provides power to a display device for the display panel system.

13. The voltage regulator of claim 12 wherein the display device is selected from a group comprising a liquid crystal display (LCD), a flat panel display, a plasma screen, and a thin film transistor (TFT) display.

14. The voltage regulator of claim 11 wherein the desired voltage is about 7.7 V.

15. The voltage regulator of claim 11 further including a transistor to pull up the voltage regulator output voltage in accordance with a result of an OR function applied to outputs of the first and second comparators.

16. The voltage regulator of claim 11 further including a transistor to pull down the voltage regulator output voltage in accordance with a result of an AND function applied to outputs of the first and second comparators.

* * * * *